US011540598B2

(12) United States Patent
Tanikawa

(10) Patent No.: US 11,540,598 B2
(45) Date of Patent: Jan. 3, 2023

(54) HEAT-FUSIBLE TEXTILE HOOK-AND-LOOP FASTENER

(71) Applicant: KURARAY FASTENING CO., LTD., Osaka (JP)

(72) Inventor: Toshihito Tanikawa, Sakai (JP)

(73) Assignee: KURARAY FASTENING CO., LTD., Osaka (JP)

( * ) Notice: Subject to any disclaimer, the term of this patent is extended or adjusted under 35 U.S.C. 154(b) by 0 days.

(21) Appl. No.: 17/419,809

(22) PCT Filed: Jan. 16, 2020

(86) PCT No.: PCT/JP2020/001256
§ 371 (c)(1),
(2) Date: Jun. 30, 2021

(87) PCT Pub. No.: WO2020/149361
PCT Pub. Date: Jul. 23, 2020

(65) Prior Publication Data

US 2022/0061470 A1 Mar. 3, 2022

(30) Foreign Application Priority Data

Jan. 18, 2019 (JP) ..... JP2019-006485

(51) Int. Cl.
*A44B 18/00* (2006.01)
*A44B 13/00* (2006.01)

(52) U.S. Cl.
CPC ..... *A44B 13/0005* (2013.01)

(58) Field of Classification Search
CPC ..... A44B 18/008; A44B 13/0005
See application file for complete search history.

(56) References Cited

FOREIGN PATENT DOCUMENTS

| | | | |
|---|---|---|---|
| JP | S62-183704 | A | 8/1987 |
| JP | H10-295418 | A | 11/1998 |
| JP | 2002000317 | A | 1/2002 |

(Continued)

OTHER PUBLICATIONS

JP 10-295418A Machine Translation produced by https://www.j-platpat.inpit.go.jp/ (Year: 2022), (11 pages).*

(Continued)

*Primary Examiner* — Robert Sandy
*Assistant Examiner* — Michael S Lee
(74) *Attorney, Agent, or Firm* — Element IP, PLC

(57) ABSTRACT

The present invention relates to a heat-fusible woven fabric hook-and-loop fastener including a woven fabric hook-and-loop fastener obtained by using a weft yarn in which a sheath component is a polyester-based hot melt resin (B) and a heat-fusible resin layer formed of a polyester-based hot melt resin (A) formed on the back surface of the woven fabric hook-and-loop fastener, wherein the heat-fusible resin layer is fused to a warp yarn only, and the melting point of the polyester-based hot melt resin (B) is higher than the melting point of the polyester-based hot melt resin (A) by 50 to 110° C. The heat-fusible woven fabric hook-and-loop fastener has excellent flexibility before being fused to an adherend, can be firmly fused and fixed to an adherend such as a fabric or a soft vinyl chloride sheet, and has excellent flexibility and high engagement force even after being fused and fixed.

6 Claims, 1 Drawing Sheet

(56) References Cited

FOREIGN PATENT DOCUMENTS

| | | | |
|---|---|---|---|
| JP | 2005226172 | A | 8/2005 |
| JP | 2016016200 | A | 2/2016 |
| JP | 2018000240 | A | 1/2018 |

OTHER PUBLICATIONS

JP 2016016200 Machine Translation produced by Patentscope (Year: 2022), (13 pages).*
JP 62-183704a Machine Translation produced by https://www.j-platpat.inpit.go.jp/ (Year: 2022), (3 pages).*
Written Opinion of the ISA of PCT/JP2020/001256, dated Feb. 25, 2020 Translation (Year: 2020) (7 pages).*
International Search Report dated Feb 25, 2020 in PCT/JP2020/001256 (with English translation), 5 pages.

* cited by examiner

[Fig. 1]
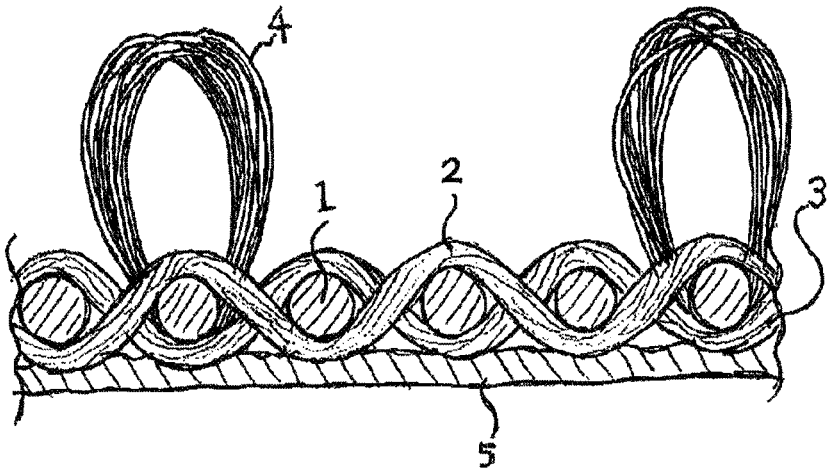
[Fig. 2]
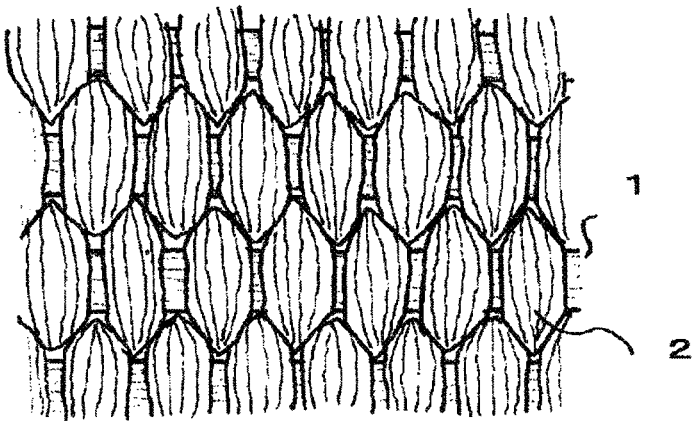

HEAT-FUSIBLE TEXTILE HOOK-AND-LOOP FASTENER

TECHNICAL FIELD

The present invention relates to a woven fabric hook-and-loop fastener capable of heat fusion with an adherend, and more particularly to a woven fabric hook-and-loop fastener capable of heat fusion (hereinafter sometimes referred to as "fusion") with an adherend, which is excellent in flexibility, can be strongly fused to a flexible adherend such as a fabric or a soft vinyl chloride sheet, can shorten the time required for fusion by using a high-frequency welder, and has a high engagement force even after fusion.

BACKGROUND ART

Conventionally, as one of means for attaching one of two objects to the other, a method of attaching two objects to each other is used in which a hook type hook-and-loop fastener having a hook type engagement element is fixed to the surface of one of the two objects, a loop type hook-and-loop fastener having a loop type engagement element is fixed to the surface of the other object, and the hook type engagement element and the loop type engagement element are engaged with each other by superposing the engagement element surfaces of both the hook-and-loop fasteners.

When the two objects (so-called adherends) are a fabric or a resin sheet, the hook-and-loop fastener is fixed to the surface of each object by sewing with a thread or bonding with various types of adhesives. In the case of such a fixing method, there are problems such as perforation of the adherend, destruction of the adherend due to application of a large force to the perforation, problem of toxicity and environmental load of an organic solvent contained in the adhesive, and time required for drying and solidification of the adhesive.

As an alternative fixing method in place of such a method, a method is used in which a fusible resin (so-called hot melt resin) is applied to the back surface of a hook-and-loop fastener (the surface opposite to the surface on which an engagement element is erected, hereinafter the same), the hot melt resin-applied surface of the hook-and-loop fastener is superposed on the surface of an adherend, and the back surface of the adherend is heated to melt the fusible resin, thereby fixing the hook-and-loop fastener to the surface of the adherend.

For example, PTL 1 discloses that the back surface of a woven fabric hook-and-loop fastener having an adhesive layer made of a hot melt adhesive on the back surface is superposed on the back surface of an artificial leather (adherend) and heated and pressed to fix the hook-and-loop fastener to the back surface of the artificial leather via the adhesive layer.

In the conventional woven fabric hook-and-loop fastener, a yarn for an engagement element woven into the woven fabric may be pulled out from the woven fabric due to the tensile force when the engaged hook type engagement element and the loop type engagement element are disengaged from each other. In order to prevent this, an adhesive called a back coat is applied to the back surface of the woven fabric hook-and-loop fastener. However, the adhesive in the back coat is penetrated into the woven fabric and is solidified, thereby hardening the entire woven fabric hook-and-loop fastener. When a hot melt resin is further applied to the back surface of such a hardened woven fabric hook-and-loop fastener, the woven fabric hook-and-loop fastener is further hardened into a plate shape. Therefore, when the adherend is a fabric, a resin sheet, or the like, the portion to which the woven fabric hook-and-loop fastener is attached becomes extremely hard, and the flexibility, touch feeling, appearance, and the like of the fabric or the resin sheet are significantly impaired. Further, when the adherend has a complicated curved surface, it is difficult to make the hard plate-shaped woven fabric hook-and-loop fastener faithfully follow such a curved surface.

PTL 2 discloses a woven fabric hook-and-loop fastener having a hot melt resin layer on the back surface as a technique for solving the problem when a hot melt resin is further applied to the back surface of such a woven fabric hook-and-loop fastener coated with a back coat. That is, PTL 2 discloses that a woven fabric hook-and-loop fastener is produced using a yarn containing a hot melt fiber as a weft yarn, a molten layer of a polyolefin-based hot melt adhesive is superposed on the back surface, the hot melt fiber of the weft yarn is melted by the heat of the molten layer, and a yarn for an engagement element woven into the hook-and-loop fastener is fixed to the woven fabric.

Certainly, when this technique is used, it is not necessary to apply an adhesive referred to as a back coat which has been generally performed in the related art, and it is possible to simplify the process and prevent the woven fabric hook-and-loop fastener from being hardened by the back coat resin. However, in order to melt the hot melt fibers forming the weft yarn, it is necessary that the heat of the hot melt adhesive applied to the back surface reaches the inside of the woven fabric sufficiently. For this purpose, it is necessary for the hot melt adhesive applied to the back surface to penetrate into the woven fabric. As a result, the amount of the hot melt adhesive remaining on the back surface of the woven fabric hook-and-loop fastener becomes small, and the heat fusion with the adherend becomes insufficient.

When the amount of the hot melt adhesive applied to the back surface is increased in order to increase the amount of the hot melt adhesive remaining on the back surface of the woven fabric hook-and-loop fastener, the amount of the hot melt adhesive penetrating into the woven fabric hook-and-loop fastener is increased accordingly, and as a result, the woven fabric hook-and-loop fastener becomes hard, and the effect of omitting the back coat treatment is reduced by half.

Further, when the fiber forming the woven fabric hook-and-loop fastener is a polyester-based fiber excellent in dimensional stability due to water absorption and light resistance, the polyolefin-based hot melt adhesive used in PTL 2 has a problem that the adhesive force with the hook-and-loop fastener is not necessarily high.

As described above, in the technique of PTL 2, the hot melt fiber forming the weft yarn of the hook-and-loop fastener needs to be melted by the heat of the hot melt adhesive applied to the back surface. Therefore, since the melting point of the hot melt fiber needs to be substantially the same as or lower than the melting point of the hot melt adhesive, it is necessary to use a hot melt fiber having a relatively low melting point. Actually, in PTL 2, a hot melt fiber having a melting point of 80 to 150° C. and a low-melting resin having a melting point close to 80 to 140° C. are used as a hot melt adhesive to be applied to the back surface.

When the melting point of the hot melt fiber used for the weft yarn is low, the hot melt fiber is melted again by the heat generated when the hot melt adhesive layer on the back surface of the hook-and-loop fastener is melted and the hook-and-loop fastener is attached to the adherend. As a result, the fixing of the yarn for an engagement element becomes insufficient, and since the rising of the engagement element from the surface of the hook-and-loop fastener base fabric is prevented by the molten hot melt fibers, the engagement force of the hook-and-loop fastener is decreased, and further the form of the hook-and-loop fastener may be impaired.

When the hot melt adhesive layer applied to the back surface is melted to fix the woven fabric hook-and-loop fastener to the adherend, a high-frequency welder is generally used industrially. If the time required for the hot melt resin to melt and solidify is long, the productivity is decreased and the molten hot melt resin is penetrated into the woven fabric of the hook-and-loop fastener before solidifying. Therefore, the hook-and-loop fastener is hardened and the amount of the hot melt resin contributing to fixing to the adherend is reduced, resulting in insufficient fixing. Further, it is necessary to prevent the shape and engaging ability of the obtained hook-and-loop fastener from being impaired until the molten hot melt resin is solidified, which requires an extra device and process.

CITATION LIST

Patent Literature

PTL 1: JP 2005-226172 A
PTL 2: JP 2002-317 A

SUMMARY OF INVENTION

Technical Problem

An object of the present invention is to provide a heat-fusible woven fabric hook-and-loop fastener having the following characteristics that:

(a) the hook-and-loop fastener has excellent flexibility, and can faithfully follow the free shape of an adherend when placed on the adherend for fixing;

(b) the hook-and-loop fastener can be firmly fused and fixed to an adherend such as a fabric or a soft vinyl chloride sheet;

(c) the hook-and-loop fastener has excellent flexibility even after being fused and fixed;

(d) the hook-and-loop fastener can be fused to an adherend in a short time using a high-frequency welder; and (e) the hook-and-loop fastener has high engagement force even after fusion to an adherend.

Solution to Problem

As a result of intensive studies, the present inventors have found that a heat-fusible woven fabric hook-and-loop fastener described in detail below achieves the above object. That is, the present invention provides a heat-fusible woven fabric hook-and-loop fastener as set forth in the following 1 to 5 and a method for producing the heat-fusible woven fabric hook-and-loop fastener as set forth in the following 6 and 7.

1. A heat-fusible woven fabric hook-and-loop fastener, including a woven fabric hook-and-loop fastener containing (i) a woven fabric composed of a warp yarn, a weft yarn, and a yarn for engagement elements and (ii) a hook-shaped or loop-shaped engagement element composed of the yarn for engagement elements, existing in large numbers on the surface of the woven fabric (i); and (iii) a heat-fusible resin layer formed of a polyester-based hot melt resin (A) laminated on the back surface of the woven fabric hook-and-loop fastener, wherein the following conditions (1) to (5) are satisfied:

(1) the weft yarn is a multifilament yarn composed of a core-sheath type filament having a polyester-based hot melt resin (B) as a sheath component, and the root of the engagement element (ii) is fixed to the woven fabric (i) by being fused to the polyester-based hot melt resin (B);

(2) the heat-fusible resin layer (iii) has a basis weight in the range of 60 to 200 g/m$^2$;

(3) the polyester-based hot melt resin (B) has a melting point of 170 to 200° C. and the melting point is higher than the melting point of the polyester-based hot melt resin (A) by 50 to 110° C.;

(4) the heat-fusible resin layer (iii) is fused to the warp yarn forming the woven fabric (i) but is not fused to the weft yarn; and (5) the heat-fusible resin layer (iii) is directly laminated on the back surface of the woven fabric (i).

2. The heat-fusible woven fabric hook-and-loop fastener as set forth in 1, wherein the polyester-based hot melt resin (A) has a melting point of 80 to 130° C.

3. The heat-fusible woven fabric hook-and-loop fastener as set forth in 1 or 2, wherein each of the warp yarn, the core component of the weft yarn, and the yarn for engagement elements is a polyester-based yarn.

4. The heat-fusible woven fabric hook-and-loop fastener as set forth in 3, wherein the polyester has a melting point higher than the melting point of the polyester-based hot melt resin (B) by 20 to 120° C.

5. A method for producing a heat-fusible woven fabric hook-and-loop fastener, the method including:

weaving a woven fabric hook-and-loop fastener formed by using a warp yarn, a weft yarn, and a yarn for engagement elements and containing (i) a woven fabric composed of the warp yarn, the weft yarn, and the yarn for engagement elements and (ii) a hook-shaped or loop-shaped engagement element composed of the yarn for engagement elements, existing in large numbers on the surface of the woven fabric (i), wherein the weft yarn is a multifilament yarn composed of a core-sheath type filament having a polyester-based hot melt resin (B) having a melting point of 170 to 200° C. as a sheath component, the root of the engagement element (ii) is fixed to the woven fabric (i) by being fused to the polyester-based hot melt resin (B), and the warp yarn covers the weft yarn so as to wrap the weft yarn on the back surface;

placing on the back surface of the woven fabric hook-and-loop fastener a molten sheet having a basis weight of 60 to 200 g/m$^2$ and formed of a polyester-based hot melt resin (A) having a melting point lower than the melting point of the polyester-based hot melt resin (B) by 50 to 110° C.; and cooling and solidifying the molten sheet as it is, thereby forming (iii) a heat-fusible resin layer on the back surface of the woven fabric hook-and-loop fastener.

6. The method for producing a heat-fusible woven fabric hook-and-loop fastener as set forth in 5, wherein the molten sheet is heated to a temperature equal to or higher than the melting point of the polyester-based hot melt resin (A) and equal to or lower than a temperature 10° C. higher than the melting point of the polyester-based hot melt resin (B) and is placed on the back surface of the woven fabric hook-and-loop fastener.

Advantageous Effects of Invention

In the woven fabric hook-and-loop fastener of the present invention, as the weft yarn constituting the woven fabric (i), a multifilament yarn composed of a core-sheath type filament containing a polyester-based hot melt resin (B) (hereinafter, sometimes simply referred to as "hot melt resin (B)") as a sheath component is used. The root of the engagement element (ii) is fixed to the woven fabric (i) by fusing to the polyester-based hot melt resin (B). Therefore, since an adhesive for back coating is not applied to the back surface as in a conventional general hook-and-loop fastener, a step of applying a back coat resin and drying it becomes unnecessary, and the production process can be simplified. In addition, since the application of the back coat resin is not necessary, the heat-fusible woven fabric hook-and-loop fastener of the present invention is superior to conventional general hook-and-loop fasteners in terms of flexibility and ability to follow the surface shape of the adherend.

In the heat-fusible woven fabric hook-and-loop fastener before being fused to the adherend, the heat-fusible resin layer (iii) is fused to the warp yarn constituting the woven fabric (i) but is hardly fused to the weft yarn, so that the presence of the heat-fusible resin layer (iii) does not greatly impair the flexibility of the woven fabric (i). Moreover, since the polyester-based hot melt resin (A) (hereinafter may be simply referred to as "hot melt resin (A)") hardly penetrates into the woven fabric (i) before fusing, most of the hot melt resin (A) in the heat-fusible resin layer (iii) is used for fusion with the adherend, and therefore the fusion between the heat-fusible woven fabric hook-and-loop fastener and the adherend becomes extremely strong. In addition, the basis weight of the heat-fusible resin layer (iii) is limited to the range of 60 to 200 g/m$^2$, both the fusion property and the flexibility of the heat-fusible woven fabric hook-and-loop fastener are achieved.

The melting point of the hot melt resin (B) used in the weft yarn is 170 to 200° C. and is higher than the melting point of the hot melt resin (A) forming the heat-fusible resin layer (iii) by 50 to 110° C., that is, the melting point of the hot melt resin (A) is lower than the melting point of the hot melt resin (B) by 50 to 110° C. For that reason, when the heat-fusible resin layer (iii) formed of the hot melt resin (A) is placed on the back surface of the woven fabric hook-and-loop fastener and laminated, the hot melt resin (B) (sheath component of the weft yarn) is hardly melted. Therefore, the fixing of the yarn for engagement elements by the hot melt resin (B) of the weft yarn is not impaired, the molten hot melt resin (B) does not prevent the engagement elements from rising from the surface of the woven fabric (i), and the form of the hook-and-loop fastener is not impaired, so that the engagement force of the obtained heat-fusible woven fabric hook-and-loop fastener is not reduced.

In the present invention, since the polyester-based hot melt resin (A) is used, the time required for fusing the heat-fusible woven fabric hook-and-loop fastener to the adherend using a high-frequency welder is short. Therefore, the productivity is improved, and penetration of the molten hot melt resin (A) into the woven fabric (i) before solidification can be reduced as much as possible, and as a result, hardening of the hook-and-loop fastener by the penetrated resin can be prevented. Further, most of the hot melt resin (A) contributes to the fusion with the adherend, so that no special apparatus or process is required for maintaining the shape of the hook-and-loop fastener during the period from the fusion with the adherend more firmly to the solidification.

BRIEF DESCRIPTION OF DRAWINGS

FIG. 1 is a cross-sectional view schematically showing an example of a heat-fusible woven fabric hook-and-loop fastener of the present invention.

FIG. 2 is a view schematically showing the back surface of the woven fabric hook-and-loop fastener before the heat-fusible resin layer (iii) is applied.

DESCRIPTION OF EMBODIMENTS

Hereinafter, the present invention will be described in detail with reference to the drawings. FIG. 1 is a cross-sectional view schematically showing an example of a heat-fusible woven fabric hook-and-loop fastener of the present invention. In the figure, reference numeral 1 denotes a weft yarn, 2 denotes a warp yarn, 3 denotes a woven fabric (i), 4 denotes an engagement element (ii), and 5 denotes a heat-fusible resin layer (iii). FIG. 1 shows a case where the engagement element (ii) of the hook-and-loop fastener is a loop-shaped engagement element. FIG. 2 is a view schematically showing the back surface of the woven fabric hook-and-loop fastener before the heat-fusible resin layer (iii) is applied, wherein reference numeral 1 denotes a weft yarn, and 2 denotes a warp yarn or a yarn for engagement elements. Also in the case of FIG. 2, the engagement element (ii) is a loop-shaped engagement element formed by using a multifilament yarn.

The heat-fusible woven fabric hook-and-loop fastener of the present invention may be any of a hook type hook-and-loop fastener, a loop type hook-and-loop fastener, and a hook/loop coexistence hook-and-loop fastener.

The hook type hook-and-loop fastener is mainly formed of a monofilament yarn for hook-shaped engagement elements, a warp yarn, and a weft yarn.

The loop type hook-and-loop fastener to be engaged with the hook type hook-and-loop fastener is mainly formed of a multifilament yarn for loop-shaped engagement elements, a warp yarn, and a weft yarn.

The hook/loop coexistence hook-and-loop fastener in which the hook-shaped engagement element and the loop-shaped engagement element coexist on the same surface is mainly formed of a monofilament yarn for hook-shaped engagement elements, a multifilament yarn for loop-shaped engagement elements, a warp yarn, and a weft yarn.

These hook-and-loop fasteners may be inwoven with yarns other than those described above, if necessary.

The warp yarn is preferably a polyester-based multifilament yarn, particularly a polyethylene terephthalate-based multifilament yarn. The multifilament yarn is preferably composed of 24 to 48 filaments and has a total thickness of 120 to 180 dtex. The warp yarn is preferably a twisted yarn because the hot melt resin (B) used for the weft yarn can efficiently fix the yarn for engagement elements.

In order to firmly fix the yarn for hook-shaped engagement elements or the yarn for loop-shaped engagement elements to the woven fabric (i), it is preferable that the warp yarn is shrunk when the weft yarn is heat fused to tighten the roots of the hook-shaped engagement elements and the loop-shaped engagement elements. For this purpose, the yarn used as the warp yarn is preferably a fiber which undergoes heat shrinkage under heat treatment conditions. Specifically, a multifilament yarn having a dry heat shrinkage at 180° C. of 5 to 10% is suitably used.

As the weft yarn, a multifilament yarn composed of a core-sheath type filament (core-sheath type heat-fusible fiber) having a polyester-based hot melt resin (B) as a sheath component is used as described above. Of course, other yarns may be mixed. Examples of the polyester-based hot melt resin (B) include copolymerized polyesters, particularly polyethylene terephthalate copolymerized with 20 to 40 mol % of isophthalic acid or polybutylene terephthalate copolymerized with 20 to 40 mol % of isophthalic acid. The melting point of the polyester-based hot melt resin (B) is in the range of 170 to 200° C. When the temperature is lower than 170° C., the binder effect is reduced when the heat-fusible resin layer (iii) is laminated, and when the temperature exceeds 200° C., the shape of the hook-and-loop fastener may be changed by heat when the hot melt resin (B) is melted to fix the yarn for engagement elements to the woven fabric (i).

As the core component of the weft yarn, a resin having a melting point far higher than that of the hot melt resin (B) is used, preferably polyester, more preferably polyethylene terephthalate is used. The ratio of the core component to the sheath component is preferably in the range of 60/40 to 80/20 by weight. The weft yarn is preferably a multifilament yarn composed of 18 to 36 filaments and having a total thickness of 80 to 120 dtex. In order to prevent the hook-and-loop fastener from warping, it is preferable to weave so that the folded weft yarn is arranged parallel to the weft yarn before folding. In this case, in the obtained woven fabric, the weft yarn apparently has a thickness twice as large as the above thickness.

Similarly to the warp yarn, it is preferable that the weft yarn is shrunk when the weft yarn is heat fused to tighten the roots of the hook-shaped engagement elements and the loop-shaped engagement elements (ii). For this purpose, the yarn used as the weft yarn is preferably a fiber which undergoes significant heat shrinkage under heat treatment conditions. Specifically, a multifilament yarn having a dry heat shrinkage at 180° C. of 15 to 25% is suitably used.

In the present invention, as described above, on the back surface of the woven fabric (i), it is necessary that the heat-fusible resin layer (iii) is fused to the warp yarn constituting the woven fabric (i) but is not fused to the weft yarn. As one method for achieving such a state, there is a method of selecting the weft yarn and the warp yarn so that the dry heat shrinkage of the weft yarn is larger than the dry heat shrinkage of the warp yarn. Specifically, it is preferable to use a combination of the warp yarn and the weft yarn such that the dry heat shrinkage of the weft yarn at 180° C. is 5 to 18% larger than that of the warp yarn.

In the present invention, the phrase "the heat-fusible resin layer (iii) is fused to the warp yarn constituting the woven fabric (i) but is not fused to the weft yarn" includes not only the case where the heat-fusible resin layer (iii) is not fused to the weft yarn at all but also the case where the heat-fusible resin layer (iii) is not fused to most of the weft yarn exposed on the back surface but is fused to a part of the weft yarn. In particular, in the case where a plurality of adjacent warp yarns (including yarns for engagement elements) exist in the same floating/sinking relationship with respect to the weft yarn, the area of the weft yarn exposed to the back surface inevitably increases at such a position. The heat-fusible resin layer (iii) may be fused to the exposed surface of the weft yarn. When there is a position where such fusion occurs, it is necessary that the area where the heat-fusible resin layer (iii) is fused to the exposed surface of the weft yarn is small in the entire hook-and-loop fastener.

Whether or not the heat-fusible resin layer (iii) is fused to the weft yarn can be easily determined by taking a micrograph of a cross section of a top portion where the warp yarn floats or a bottom portion where the warp yarn sinks most in parallel to the warp yarn of the hook-and-loop fastener provided with the heat-fusible resin layer (iii) and observing whether or not a space is formed between the heat-fusible resin layer (iii) and the weft yarn.

The hook-shaped engagement element constituting a hook type hook-and-loop fastener or a hook/loop coexistence hook-and-loop fastener is required to have so-called hook shape retention and rigidity in which a hook shape is not extended by a weak force, and therefore a thick monofilament yarn is used as a yarn for the hook-shaped engagement element. In particular, a yarn which is formed of polyester excellent in hook shape retention, preferably formed of polyethylene terephthalate or polybutylene terephthalate, and does not melt at the temperature at which the weft yarn is heat fused is used. The monofilament yarn for hook-shaped engagement elements formed of such polyester preferably has a thickness of 250 to 400 dtex.

The yarn for loop-shaped engagement elements constituting the loop type hook-and-loop fastener or the hook/loop coexistence hook-and-loop fastener is also formed of polyester, preferably formed of polyethylene terephthalate or polybutylene terephthalate, similarly to the yarn for hook-shaped engagement elements. The multifilament yarn forming the yarn for loop-shaped engagement elements is preferably composed of 5 to 10 filaments and has a total thickness of 130 to 300 dtex. In the present invention, it is preferable that all of the warp yarn, the core component of the weft yarn, and the yarn for engagement elements are formed of a polyester having a melting point higher than the melting point of the hot melt resin (B) by 20 to 120° C., because the heat treatment described later can be reliably performed.

Hereinafter, a method for producing the heat-fusible woven fabric hook-and-loop fastener of the present invention will be described, but the method is not limited to the following production method as long as the effects of the present invention are obtained.

A woven fabric for a woven fabric hook-and-loop fastener is first woven from the warp yarn, the weft yarn, the monofilament yarn for hook-shaped engagement elements or multifilament yarn for loop-shaped engagement elements described above. As the weaving structure of the woven fabric, a plain weave using a monofilament yarn for hook-shaped engagement elements or a multifilament yarn for loop-shaped engagement elements as a part of warp yarn is preferable. In the case of the loop type hook-and-loop fastener, a woven fabric is woven from a warp yarn, a weft yarn, and a multifilament yarn for loop-shaped engagement elements; in the case of a hook type hook-and-loop fastener, a woven fabric is woven from a warp yarn, a weft yarn, and a monofilament yarn for hook-shaped engagement elements; and in the case of a hook/loop coexistence hook-and-loop fastener, a woven fabric is woven from a warp yarn, a weft yarn, a monofilament yarn for hook-shaped engagement elements, and a multifilament yarn for loop-shaped engagement elements.

In the obtained woven fabric, it is preferable that the yarns for hook-shaped engagement elements are driven into the woven fabric in parallel to the warp yarns, float on the surface of the woven fabric, jump over one to three warp yarns while forming loops, and then sink between the warp yarns to form a weaving structure, because one leg of the loop for hook-shaped engagement elements can be cut efficiently and the hook-shaped engagement element and the loop-shaped engagement element thus obtained can be easily engaged with each other.

It is preferable that the yarn for loop-shaped engagement elements forms a loop on the woven fabric without jumping over the warp yarn and forms a weaving structure in which the loop is present in parallel to the warp yarn because the hook-shaped engagement element and the loop-shaped engagement element thus obtained can be easily engaged with each other.

In the case of the hook/loop coexistence hook-and-loop fastener, it is preferable that the yarn for hook-shaped engagement elements and the yarn for loop-shaped engagement elements each form the above-described weaving structure, because one leg side portion of the loop for hook-shaped engagement elements can be efficiently cut, and the hook-shaped engagement element and the loop-shaped engagement element thus obtained can be easily engaged with each other.

It is preferable that the weaving density of the warp yarns is 45 to 70 yarns/cm, the weaving density of the weft yarns is 15 to 25 yarns/cm, and the number of weaving of the warp yarns is 2.5 to 3.5 times the number of weaving of the weft yarns, because the warp yarn can cover the weft yarn so as to wrap the weft yarn on the back surface of the woven fabric (i), or the heat-fusible resin layer (iii) is fused to the warp yarn forming the woven fabric (i) but is not fused to the weft yarn in a later step. During the production of the woven fabric, it is preferable to apply a less tension to the warp yarn while applying a high tension to the weft yarn because the warp yarn can cover the weft yarn so as to wrap the weft yarn on the back surface of the woven fabric (i).

The weight ratio of the weft yarn is preferably 30 to 40% with respect to the total weight of the yarn for hook-shaped engagement elements or the yarn for loop-shaped engagement elements, the warp yarn, and the weft yarn constituting the woven fabric. In the case of a woven fabric for a hook/loop coexistence hook-and-loop fastener, it is preferably 30 to 40% with respect to the total weight of the yarn for hook-shaped engagement elements, the yarn for loop-shaped engagement elements, the warp yarn, and the weft yarn.

The driving number of the monofilament yarns for hook-shaped engagement elements and the driving number of the multifilament yarns for loop-shaped engagement elements are preferably about 3 to 5 yarns with respect to 20 warp yarns (including the monofilament yarn for hook-shaped engagement elements or the multifilament yarn for loop-shaped engagement elements), respectively. In the case of the hook/loop coexistence hook-and-loop fastener, the total driving number of the monofilament yarns for hook-shaped engagement elements and the multifilament yarns for loop-shaped engagement elements is preferably 3 to 5 yarns with respect to 20 warp yarns (including the monofilament yarn for hook-shaped engagement elements and the multifilament yarn for loop-shaped engagement elements), and the number ratio of the monofilament yarn for hook-shaped engagement elements and the multifilament yarn for loop-shaped engagement elements is preferably 40:60 to 60:40.

The woven fabric for the thus obtained woven fabric hook-and-loop fastener is subjected to heat treatment to melt the sheath component of the core-sheath type heat-fusible fiber (weft yarn) and at the same time largely shrink the warp yarn and the weft yarn, particularly the weft yarn, thereby firmly fixing the monofilament yarn for hook-shaped engagement elements and the multifilament yarn for loop-shaped engagement elements to the woven fabric. As a result, the back coat treatment which has been performed in the conventional production of the hook-and-loop fastener becomes unnecessary, a step of applying and drying the adhesive for back coating can be omitted, and the hardening of the hook-and-loop fastener by the adhesive for back coating can be prevented. Further, since the shape of the loop for hook-shaped engagement elements is fixed by this heat treatment, the hook-shaped engagement element obtained by cutting one leg of the loop for hook-shaped engagement elements also maintains the hook shape, and sufficient engagement strength is obtained.

The heat treatment temperature is preferably a temperature at which the hot melt resin (B) forming the sheath component of the weft yarn is melted but the other yarns are not melted, and a temperature at which the monofilament yarn for hook-shaped engagement elements is heat fixed, and more preferably 185 to 210° C. The heat treatment is carried out by running the woven fabric for a woven fabric hook-and-loop fastener in a heated atmosphere without applying pressure.

Next, in the case of the hook type hook-and-loop fastener or the hook/loop coexistence hook-and-loop fastener, one leg of the loop for the hook-shaped engagement element protruding from the surface of the woven fabric for the heat-treated woven fabric hook-and-loop fastener is cut to form the hook-shaped engagement element, thereby obtaining the woven fabric hook-and-loop fastener composed of the woven fabric (i) and the engagement element (ii). It is preferable that the height of the hook-shaped engagement elements is 1.5 to 2.0 mm from the surface of the woven fabric (i) and the height of the loop-shaped engagement elements is 2.0 to 2.8 mm from the surface of the woven fabric (i) from the viewpoint that the engagement force is strong and the hook-shaped engagement element is less likely to fall down.

The density of the hook-shaped engagement elements in the hook type hook-and-loop fastener, the density of the loop-shaped engagement elements in the loop type hook-and-loop fastener, and the total density of the hook-shaped engagement elements and the loop-shaped engagement elements in the hook/loop coexistence hook-and-loop fastener are preferably 40 to 70 elements/$cm^2$, 30 to 50 elements/$cm^2$, and 30 to 60 elements/$cm^2$, respectively, based on the surface areas of the woven fabric (i). In the hook/loop coexistence hook-and-loop fastener, the ratio of the number of the hook-shaped engagement elements to the number of the loop-shaped engagement elements is preferably in the range of 40:60 to 60:40.

The thus obtained woven fabric hook-and-loop fastener has a woven fabric (i) composed of a warp yarn, a weft yarn, and a yarn for engagement elements and a large number of hook-shaped or loop-shaped engagement elements (ii) rising from the surface of the woven fabric (i). The weft yarn is a multifilament yarn composed of a core-sheath type filament having a polyester-based hot melt resin (B) having a melting point of 170 to 200° C. as a sheath component, and the root of the engagement element (ii) is fixed to the woven fabric (i) by melting of the hot melt resin (B).

The back surface of the woven fabric (i) is covered so that the warp yarn wraps the weft yarn. The state of the back surface is schematically shown in FIG. 2. That is, the back surface of the woven fabric (i) is substantially covered with the warp yarns 2 (including the yarn for engagement elements), the weft yarns 1 are slightly visible through the gaps between the warp yarns 2, and the weft yarns 1 are substantially covered with the warp yarns 2. Specifically, in a photograph or the like of the back surface taken from directly above, the area of the warp yarn 2 is preferably 75 to 95% and the area of the weft yarn 1 is preferably 5 to 25% with respect to the total of the area of the warp yarn 2 (including the yarn for engagement elements) and the area of the weft yarn 1.

A molten sheet having a basis weight of 60 to 200 g/$m^2$ and formed of a polyester-based hot melt resin (A) having a melting point lower than the melting point of the hot melt resin (B) by 50 to 110° C., preferably 70 to 100° C., is placed on the back surface of the thus obtained woven fabric hook-and-loop fastener.

In the present invention, as described above, it is necessary that the heat-fusible resin layer (iii) is directly laminated on the back surface of the woven fabric (i). The term "directly laminated" means that the heat-fusible resin layer (iii) is directly applied to the back surface of the woven fabric (i) without performing back coating which is performed in the production of conventional general hook-and-loop fasteners.

The melting point referred to in the present invention means the temperature of a melting peak by DSC, and when no melting peak by DSC is shown, it means the softening temperature measured under a load of 1 kg by an HDT tester manufactured by Toyo Seiki Seisaku-sho, Ltd.

In the present invention, the hot melt resin (A) must be a polyester-based resin. There are many kinds of hot melt resins such as polyamide-based resins, polyolefin-based resins, and polyurethane-based resins. In the present invention, a polyester-based resin is used because it has advantages such as it can be fused to an adherend in a short time using a high-frequency welder, the bonding force between the woven fabric (i) and the heat-fusible resin layer (iii) after fusion is large, and the hook-and-loop fastener after application of the heat-fusible resin layer (iii) does not curl due to water absorption or the like.

The polyester-based hot melt resin (A) is a resin composed of a copolyester of a dicarboxylic acid component selected from terephthalic acid, isophthalic acid, 1,4-cyclohexanedicarboxylic acid and the like and a glycol component selected from diethylene glycol, triethylene glycol, 1,4-butanediol, 1,9-nonanediol, polytetramethylene glycol and the like, and having a melting point of 80 to 130° C.

The melting point (melting point A) of the polyester-based hot melt resin (A) needs to be lower than the melting point (melting point B) of the polyester-based hot melt resin (B) forming the sheath component of the weft yarn by 50 to 110° C. When the difference between the melting point B and the melting point A is less than 50° C., the sheath component fixing the woven fabric is eluted again when the molten sheet formed of the hot melt resin (A) is superposed on the back surface of the woven fabric hook-and-loop fastener, whereby the form of the hook-and-loop fastener is impaired, the flexibility of the woven fabric (i) is greatly impaired, or the engagement force is reduced. When the difference between the melting point B and the melting point A is more than 110° C., the hot melt resin (A) is easily eluted by the subsequent heat treatment or by the heating when the product is bonded to an adherend, so that the bonding force to the adherend is decreased or the performance of the adherend is deteriorated.

Inorganic fine particles of talc, silica, titanium oxide or the like may be added as a crystal nucleating agent to the hot melt resin (A). Further, stabilizers such as antioxidants and ultraviolet absorbers and colorants such as dyes and pigments may be added. If the amount is small, other resins or fibrous materials may be added, for example.

The molten sheet of the polyester-based hot melt resin (A) is placed on the back surface of the woven fabric (i) covered with the warp yarn so as to wrap the weft yarn, and is cooled and solidified as it is. As a general method for forming a resin layer on the surface of a woven fabric, there are various methods such as a method of applying and drying a low-viscosity solution in which a resin is dissolved, and a method of applying a molten resin liquid and pressing to impregnate the resin liquid into the woven fabric. In the present invention, as described above, a molten sheet of the polyester-based hot melt resin (A) (hereinafter, may be simply referred to as a "molten sheet") is placed on the back surface of the woven fabric (i), and is cooled and solidified as it is. Specifically, the molten hot melt resin (A) is extruded into a sheet form from an injection extruder to obtain a molten sheet, the molten sheet is placed on the back surface of the woven fabric (i) while the resin is kept in a molten state, and the molten sheet is cooled and solidified as it is without performing other operations such as pressing to obtain the heat-fusible woven fabric hook-and-loop fastener of the present invention.

By using such a method, it is possible to obtain a state in which the polyester-based hot melt resin (A) does not deeply penetrate into the woven fabric (i), and the heat-fusible resin layer (iii) is fused to the warp yarn on the back surface of the woven fabric (i) but is not fused to the weft yarn. As a result, the heat-fusible woven fabric hook-and-loop fastener before fusing to the adherend has excellent flexibility and can faithfully follow the free shape of the adherend. Therefore, it can be firmly fused and fixed to a flexible adherend such as a fabric or a soft vinyl chloride sheet.

In the present invention, the temperature of the molten sheet formed of the hot melt resin (A) to be placed on the back surface of the woven fabric (i) is preferably equal to or higher than the melting point of the hot melt resin (A) and equal to or lower than a temperature 10° C. higher than the melting point of the hot melt resin (B). Within such a temperature range, the placed molten sheet of the hot melt resin (A) hardly melts the sheath component resin (hot melt resin (B)) of the weft yarn, and there is no problem due to re-melting of the hot melt resin (B). Specifically, a temperature range of 150 to 195° C. is preferable.

The basis weight of the heat-fusible resin layer (iii) is in the range of 60 to 200 g/m$^2$. When the basis weight is less than 60 g/m$^2$, the heat-fusible woven fabric hook-and-loop fastener cannot be sufficiently fused to the adherend by the subsequent hot melt fusion. When the basis weight exceeds 200 g/m$^2$, a large amount of the excess hot melt resin (A) eluted during hot melt fusion to the adherend penetrates into the woven fabric of the heat-fusible woven fabric hook-and-loop fastener, and as a result, the flexibility of the hook-and-loop fastener is greatly impaired, the performance of the adherend is impaired, or the appearance is impaired. More preferably, it is in the range of 70 to 180 g/m$^2$.

The heat-fusible woven fabric hook-and-loop fastener of the present invention, in which the heat-fusible resin layer (iii) is integrally fused to the back surface of the woven fabric (i), is a fastener in which the heat-fusible resin layer (iii) is directly laminated on the back surface of the woven fabric (i) and the heat-fusible resin layer (iii) is fused to the warp yarn forming the woven fabric (i) but is not fused to the weft yarn, and therefore has excellent flexibility, can faithfully follow the free surface shape of the adherend, can be firmly fused and fixed to the adherend, has excellent flexibility even after being fused and fixed, can be fused to the adherend in a short time using a high-frequency welder, and has high engagement force.

The heat-fusible woven fabric hook-and-loop fastener of the present invention can be fused to the surface of a vinyl chloride sheet or molded article by a high-frequency welder. For example, the heat-fusible woven fabric hook-and-loop fastener of the present invention is fused and fixed to a floor material (adherend) made of vinyl chloride forming a floor surface of an automobile. By engaging a mat or other material (mating material) in which a hook-and-loop fastener capable of engaging with a heat-fusible woven fabric hook-and-loop fastener is attached to the back surface, with a heat-fusible woven fabric hook-and-loop fastener fixed to a floor material, the mat or other material can be fixed to the floor of an automobile. Further, a mating material having a hook-and-loop fastener capable of engaging with the heat-fusible woven fabric hook-and-loop fastener on the surface can be attached to a fabric, a nonwoven fabric sheet, a vinyl chloride sheet or the like in which the heat-fusible woven fabric hook-and-loop fastener of the present invention is heat fused on the surface.

The heat-fusible woven fabric hook-and-loop fastener of the present invention can be used in application fields in which conventional general hook-and-loop fasteners are used, and can be used in a wide range of fields such as shoes, bags, gloves, clothing, sphygmomanometers, supporters, various toys, fixing materials for civil engineering and construction sheets, and fixing materials for various panels and wall materials. The heat-fusible woven fabric hook-and-loop fastener of the present invention can be used as a hook type hook-and-loop fastener, a loop type hook-and-loop fastener, or a hook/loop coexistence hook-and-loop fastener.

EXAMPLES

Hereinafter, the present invention will be described with reference to Examples. In the examples, the dry heat shrinkage (filament shrinkage B method) was measured in conformity with JIS-L-1013 method, the engagement force of a heat-fusible woven fabric hook-and-loop fastener (hereinafter sometimes referred to simply as "hook-and-loop fastener") was measured in conformity with JIS-L-3416 method, and the bonding force between the hook-and-loop fastener and the adherend was measured in conformity with JIS-K-6854 method (fusion length: 60 mm in the case of heat fusion, fusion length: 5 mm in the case of high-frequency welder fusion, peeling rate: 300 mm per minute).

Example 1

The following yarns were used as a warp yarn, a weft yarn, a monofilament yarn for a hook-shaped engagement element, and a multifilament yarn for a loop-shaped engagement element constituting a woven fabric and an engagement element of a hook-and-loop fastener.

[Warp Yarn]

Multifilament yarn formed of polyethylene terephthalate having a melting point of 260° C.

Total dtex and the number of filaments: 167 dtex and 30 filaments

Dry heat shrinkage at 180° C.: 7.2%

[Weft Yarn (Multifilament Heat-fusible Yarn composed of Core-Sheath Type Composite Fibers)]

Core component: polyethylene terephthalate (melting point: 260° C.)

Sheath component: polybutylene terephthalate copolymerized with 25 mol % of isophthalic acid (melting point: 190° C.)

Core/sheath ratio (weight ratio): 70:30

Total dtex and the number of filaments: 110 dtex and 24 filaments

Dry heat shrinkage at 180° C.: 21.2%

[Monofilament Yarn for Hook-shaped Engagement Element]

Monofilament yarn made of polyethylene terephthalate (melting point: 260° C.)

Fineness: 330 dtex (diameter: 0.18 mm)

[Multifilament Yarn for Loop-shaped Engagement Element]

Multifilament yarn formed of polybutylene terephthalate (melting point: 220° C.)

Total dtex and the number of filaments: 265 dtex and 7 filaments

Woven fabric hook-and-loop fasteners (hook type hook-and-loop fastener and loop type hook-and-loop fastener) were produced under the following conditions using the above four kinds of yarns.

[Hook Type Hook-and-Loop Fastener]

A plain weave fabric having a weaving density (after heat shrinkage treatment) of 58 warp yarns/cm and 20 weft yarns/cm was woven using the warp yarn, the weft yarn, and the monofilament for a hook-shaped engagement element described above. A monofilament yarn for a hook-shaped engagement element was driven in parallel to a ground warp yarn at a ratio of one to four warp yarns, three weft yarns were floated and sunk on the monofilament yarn, the monofilament yarn jumped over three warp yarns while forming a loop, and then was sunk between the warp yarns to form a loop on the woven fabric.

The woven fabric for the hook type hook-and-loop fastener obtained as described above was subjected to heat treatment in a temperature range in which only the sheath component of the weft yarn was heat melted and the warp yarn, the monofilament for a hook engagement element, and the core component of the weft yarn were not heat melted, that is, at 200° C. The weft yarn and the warp yarn were shrunk, particularly the weft yarn was largely shrunk, and the sheath component was melted to fuse the yarn existing in the vicinity. As a result, the woven fabric was shrunk by 10% in the weft direction. Then, after the obtained woven fabric was cooled, one leg of the loop for a hook-shaped engagement element was cut to form a hook-shaped engagement element. The root of the obtained hook-shaped engagement element was fixed to the woven fabric by fusion of the sheath component.

The obtained hook type hook-and-loop fastener had a hook-shaped engagement element density of 62 elements/$cm^2$, and the height of the hook-shaped engagement elements from the surface of the base fabric was 1.6 mm. 85% of the back surface was covered with the warp yarns (including yarns for engagement elements).

[Loop Type Hook-and-Loop Fastener]

A plain weave fabric having a weaving density (after heat shrinkage treatment) of 58 warp yarns/cm and 20 weft yarns/cm was woven using the warp yarn, the weft yarn, and the multifilament yarn for a loop-shaped engagement element described above. A multifilament for a loop-shaped engagement element was driven in parallel to the warp yarn without jumping over the warp yarn at a ratio of one to four warp yarns, and five weft yarns were floated and sunk on the multifilament to form a loop on the woven fabric.

The woven fabric for the loop type hook-and-loop fastener obtained as described above was subjected to heat treatment at 200° C. at which only the sheath component of the weft yarn was heat melted and the warp yarn, the multifilament for a loop engagement element, and the core component of the weft yarn were not heat melted. The warp yarn and the weft yarn were shrunk, particularly the weft yarn was largely shrunk, and the sheath component was melted to fuse the yarn existing in the vicinity. As a result, the woven fabric was shrunk by 13% in the weft direction. The loop type hook-and-loop fastener obtained by cooling the obtained woven fabric had a loop-shaped engagement element density of 46 elements/$cm^2$, the height of the loop-shaped engagement elements from the surface of the woven fabric was 2.4 mm, and the root of the loop-shaped engagement element was fixed to the woven fabric by fusion of the polyester-based hot melt resin of the sheath component. When the back surface of the loop type hook-and-loop fastener was observed, the warp yarn covered the weft yarn so as to wrap the weft yarn, and when the back surface was touched with a hand, only the warp yarn was touched. 85% of the back surface was covered with the warp yarns (including yarns for engagement elements).

A polyester-based hot melt resin (Vylon GA6400, manufactured by Toyobo Co., Ltd., melting point: 96° C.) was extruded from an injection extruder to obtain a resin sheet.

A molten sheet (basis weight: 100 g/m$^2$) obtained by heating and melting this resin sheet at 180° C. was placed on the back surfaces of the obtained hook type hook-and-loop fastener and loop type hook-and-loop fastener without applying the back coat resins, and was solidified as it was to form a heat-fusible resin layer, thereby obtaining a heat-fusible woven fabric hook-and-loop fastener.

When a cross section of the obtained heat-fusible woven fabric hook-and-loop fastener (hook type hook-and-loop fastener and loop type hook-and-loop fastener) was observed with a microscope, it was observed that the heat-fusible resin layer was fused to the warp yarn constituting the woven fabric but was not fused to the weft yarn.

The heat-fusible woven fabric hook type hook-and-loop fastener and the heat-fusible woven fabric loop type hook-and-loop fastener obtained in this manner were both flexible and capable of faithfully following the curved surface of the adherend surface in spite of the existence of the heat-fusible resin layer on the back surface.

A cotton fabric having a basis weight of 200 g/m$^2$ was selected as an adherend, the cotton fabric was superposed on the heat-fusible resin layer on the back surface of each of the hook type hook-and-loop fastener and the loop type hook-and-loop fastener, and the cotton fabric was pressure-bonded under heating with a heating plate at 120° C. to fuse each hook-and-loop fastener to the adherend.

The obtained adherend with a hook-and-loop fastener slightly lost flexibility as compared with that before fusing, but still had flexibility allowing free bending. Further, in order to measure the bonding force between the hook-and-loop fastener and the adherend, the strength required for peeling the hook type hook-and-loop fastener or the loop type hook-and-loop fastener from the adherend was measured with a tensile tester. As a result, there was almost no difference between the hook type hook-and-loop fastener and the loop type hook-and-loop fastener, and the average value was 21.6 N/cm. When the peeled portion was observed, the adherend was internally broken to cause peeling.

Further, it was found that the engagement force of the hook-and-loop fastener after fusing to the adherend was completely the same as that before fusing, and an extremely excellent heat-fusible woven fabric hook-and-loop fastener was obtained. The engagement force was measured by engaging the hook type hook-and-loop fastener and the loop type hook-and-loop fastener with each other. The initial engagement strength was 10.3 N/cm$^2$ for shear strength and 1.18 N/cm for peeling strength before fusing.

A soft vinyl chloride sheet of 0.3 mm thick was layered on the back surface side of the heat-fusible woven fabric hook-and-loop fastener, and high-frequency welding was performed using a welder manufactured by Yamamoto Vinita Co., Ltd., under conditions of a current of 0.20 A, a horn radius of 25 mm×5 mm, and a cooling time of 3.0 seconds. As a result, it was found that strong fusion can be performed in an energization time of 1.5 seconds, and fusion can be performed in a short time by a high-frequency welder. The bonding force between the heat-fusible woven fabric hook-and-loop fastener and the adherend was as extremely high as 29 N/cm and was excellent.

Example 2

In the same manner as in Example 1, except that a polyester resin having a melting point of 112° C. (Vylon GM900 manufactured by Toyobo Co., Ltd.) was used as the hot melt resin for the heat-fusible resin layer, a heat-fusible resin layer was formed on the back surfaces of the hook type hook-and-loop fastener and the loop type hook-and-loop fastener. In each of the obtained heat-fusible woven fabric hook-and-loop fasteners, it was confirmed from the microscopic observation of the cross section that the heat-fusible resin layer was fused to the warp yarn constituting the woven fabric but was not fused to the weft yarn in the same manner as in Example 1.

Further, it was fused to an adherend (cotton cloth) in the same manner as in Example 1 except that the fusing temperature was changed by 130° C. The obtained adherend with a hook-and-loop fastener had flexibility allowing free bending as in Example 1. There was almost no difference in the bonding force between the hook type hook-and-loop fastener and the adherend and the bonding force between the loop type hook-and-loop fastener and the adherend, and the average value was 19.7 N/cm. When the peeled portion was observed, the peeling was caused by internal destruction of the adherend. Further, it was found that the engagement force of the hook-and-loop fastener after fusing to the adherend was also extremely excellent as in Example 1, and an excellent heat-fusible woven fabric hook-and-loop fastener was obtaianed. Further, when the fusion property to the soft vinyl chloride sheet was also examined in the same manner as in Example 1, the bonding force was as extremely high as 19.7 N/cm, and it was an excellent heat-fusible woven fabric hook-and-loop fastener.

Comparative Example 1

A heat-fusible resin layer was formed on the back surfaces of the hook type hook-and-loop fastener and the loop type hook-and-loop fastener in the same manner as in Example 1 except that a polyester resin having a melting point of 166° C. (Vylon GM925, manufactured by Toyobo Co., Ltd.) was used as the hot melt resin for the heat-fusible resin layer, and the heating and melting temperature of the molten sheet was changed to 195° C. The obtained hook type hook-and-loop fastener and loop type hook-and-loop fastener each with a heat-fusible resin layer were fused to an adherend (cotton cloth) in the same manner as in Example 1.

As a result, many of the loop-shaped engagement elements and hook-shaped engagement elements of the hook-and-loop fasteners fell down and adhered to the woven fabric, so that the engagement force was extremely low and the hook-and-loop fasteners could not be used. In addition, the flexibility of each hook-and-loop fastener was significantly impaired as compared with Example 1. This is probably because the woven fabric of the hook-and-loop fasteners was hardened in a pressed state during press-bonding under heating.

Comparative Example 2

A heat-fusible resin layer was formed on the back surfaces of the hook type hook-and-loop fastener and the loop type hook-and-loop fastener in the same manner as in Example 1 except that a nylon-based hot melt resin having a melting point of 90° C. (PR F-915G, manufactured by Toyo Ink Co., Ltd.) was used as the hot melt resin for the heat-fusible resin layer, and the heating and melting temperature of the molten sheet was changed to 170° C. The obtained hook type hook-and-loop fastener and loop type hook-and-loop fastener each with a heat-fusible resin layer were fused to an adherend (cotton cloth) in the same manner as in Example 1.

The obtained adherend with a hook-and-loop fastener had flexibility allowing free bending as in Example 1, but the bonding strength between the hook-and-loop fastener and the adherend was almost no difference between in the case of the hook type hook-and-loop fastener and in the case of the loop type hook-and-loop fastener, and the average value thereof was only 2.0 N/cm. When the peeled portion was observed, peeling occurred at the interface between the adherend and the heat-fusible resin layer in each case.

Examples 3 and 4 and Comparative Examples 3 and 4

In the same manner as in Example 1 except that the basis weight of the heat-fusible resin layer was changed to 40 g/m$^2$ (Comparative Example 3), 70 g/m$^2$ (Example 3), 150 g/m$^2$ (Example 4), and 250 g/m$^2$ (Comparative Example 4), heat-fusible woven fabric hook-and-loop fasteners having a heat-fusible resin layer on the back surface were produced. In each of the obtained heat-fusible woven fabric hook-and-loop fasteners, it was confirmed from the microscopic observation of the cross section that the heat-fusible resin layer was fused to the warp yarn constituting the woven fabric but was not fused to the weft yarn.

In Example 3, the bonding force between the heat-fusible woven fabric hook-and-loop fastener and the adherend (cotton cloth) was 11.8 N/cm, which was lower than that in Example 1, but was sufficiently excellent bonding force for practical use. When the adherend was replaced with a soft vinyl chloride sheet and fused in the same manner as in Example 1, the bonding force was 17.3 N/cm, which was almost the same as that of Example 1 and was excellent bonding force.

In Example 4, the bonding force between the hook-and-loop fastener and the adherend (cotton cloth) was as extremely high as 35.5 N/cm and was extremely excellent. The peeling was caused by internal destruction of the heat-fusible resin layer. It was considered that the heat-fusible resin had penetrated into the woven fabric, and the hook-and-loop fastener became slightly hard, but in this respect, it was slightly inferior to that of Example 1. The other points were the same as those in Example 1 and were satisfactory.

When the adherend was replaced with a soft vinyl chloride sheet and fused in the same manner as in Example 1, the bonding force was 19.2 N/cm, which was almost the same as that of Example 1 and was excellent bonding force.

On the other hand, in Comparative Example 3, the average value of the bonding force between the hook type hook-and-loop fastener and the adherend and the bonding force between the loop type hook-and-loop fastener and the adherend was as extremely low as 2.9 N/cm, and the hook-and-loop fastener was easily peeled off from the adherend (cotton cloth). Peeling occurred at the bonding surface between the adherend and the heat-fusible resin layer. When the cross section was observed with a microscope, it was found that most of the heat-fusible resin penetrated into the woven fabric and there were few portions that could be regarded as heat-fusible resin layers.

In Comparative Example 4, the bonding force between the hook-and-loop fastener and the adherend was as high as 32.7 N/cm, which was excellent, and the peeling was due to the internal destruction of the heat-fusible resin layer. However, the hook-and-loop fastener was very hard and appeared to be a plastic plate, greatly impairing the texture of the cotton cloth.

Comparative Example 5

In the production of the loop type hook-and-loop fastener of Example 1, warp yarns having a dry heat shrinkage of 13.3% at 180° C. and weft yarns having a dry heat shrinkage of 12.8% at 180° C. were used, respectively, and woven so as to have a weaving density of 25 warp yarns/cm and 24 weft yarns/cm. During weaving, the warp tension was increased and the weft tension was decreased. Further, the yarn for loop-shaped engagement elements was inwoven at a ratio of one to two warp yarns. The other conditions were the same as in Example 1. When the back surface of the obtained loop type hook-and-loop fastener was observed, the warp yarn did not cover the weft yarn so as to wrap the weft yarn, but the warp yarn and the weft yarn were alternately exposed on the back surface to the same extent. A heat-fusible resin layer was laminated on the back surface of the obtained loop type hook-and-loop fastener in the same manner as in Example 1.

When the back surface of the obtained loop type hook-and-loop fastener on which the heat-fusible resin layer was laminated was observed, it was observed that the heat-fusible resin layer was substantially uniformly fused to both the warp yarn and the weft yarn constituting the woven fabric. That is, both the warp yarn and the weft yarn were fixed by the heat-fusible resin layer on the back surface, and the flexibility was far inferior to that of the heat-fusible woven fabric loop type hook-and-loop fastener of Example 1. Therefore, it could be easily predicted that it would be difficult to adhere faithfully to the surface of an adherend having a complicated curved surface.

Comparative Example 6

A hook type hook-and-loop fastener having a heat-fusible resin layer on the back surface was produced in the same manner as in Example 1, except that a polyurethane-based hot melt resin (E790HSJR, manufactured by Nippon Miractran Co., Ltd.) was used as the heat-fusible resin (A). A soft vinyl chloride sheet of 0.3 mm thick was layered on the back surface side of the hook type hook-and-loop fastener with a heat-fusible resin layer, and high-frequency welding was performed using a welder manufactured by Yamamoto Vinita Co., Ltd., under the same conditions as in Example 1. As a result, it was found that it took 4 seconds or more for fusing, and it took too long for industrial implementation. In addition, the bonding force was about half that of Example 1, which was also unsatisfactory.

Comparative Example 7

In the production of the hook type hook-and-loop fastener of Example 1, a solution of polyester-based polyurethane as a back coat resin was applied to the back surface of the obtained hook type hook-and-loop fastener so as to have a basis weight of 40 g/m$^2$ (solid content), and the solvent of the back coat solution was removed and dried to obtain a hook type hook-and-loop fastener having a back coat layer.

A sheet of a nylon-based hot melt resin (PR F-915G, manufactured by Toyo Ink Co., Ltd.) having a melting point of 90° C. was heated and melted at 170° C. to obtain a molten sheet (basis weight 130 g/m$^2$). This molten sheet was placed on the back coat surface of the obtained hook type hook-and-loop fastener having a back coat layer and solidified to produce a hot melt fusible hook type hook-and-loop fastener.

Since the obtained hot melt fusible hook type hook-and-loop fastener, in which the back coat resin has penetrated into the woven fabric, and the warp yarn, the weft yarn, and the yarn for hook-shaped engagement elements have been fixed was extremely hard and plate-shaped and, it has been difficult to faithfully follow the surface of an adherend which has a complicated curved surface shape.

This hot melt fusible hook type hook-and-loop fastener was attempted to be fused to a cotton cloth and a soft vinyl chloride sheet in the same manner as in Example 1. In the case of the cotton cloth, the hook-and-loop fastener was fused with the same bonding force as in Example 1, but in the case of the soft vinyl chloride sheet, the hook-and-loop fastener could not be fused at all, and the soft vinyl chloride sheet and the hot melt layer were easily peeled off at the interface therebetween, which was not practical.

Comparative Example 8

A hook type hook-and-loop fastener having a heat-fusible resin layer on the back surface was produced in the same manner as in Example 1, except that a polycaprolactone-based polyester resin (melting point: 60° C.) was used instead of the polyester-based hot melt resin in Example 1. It has been found that when the temperature of the atmosphere exceeds 50° C., the hook type hook-and-loop fastener with the heat-fusible resin layer has a drastically reduced bonding force to an adherend. Therefore, it could be easily expected that the hook type hook-and-loop fastener with the heat-fusible resin layer is not suitable for use as an automobile member or a building member and has no general-purpose properties because the bonding force is decreased at a high temperature in summer.

Examples 5 and 6 and Comparative Examples 9 and 10

In the same manner as in Example 1 except that the sheath component of the core-sheath type composite fiber used for the weft yarn was changed to polyester having a melting point of 155° C. (Comparative Example 9), polyester having a melting point of 182° C. (Example 5), polyester having a melting point of 197° C. (Example 6), and polyester having a melting point of 215° C. (Comparative Example 10), the heat treatment temperature of the woven fabric for loop type hook-and-loop fasteners was changed to a temperature 10° C. higher than the melting point of the polyester, four types of loop type hook-and-loop fasteners having a heat-fusible resin layer on the back surface were obtained.

The melting point of the polyester (copolymerized polybutylene terephthalate) was adjusted by changing the copolymerization ratio of isophthalic acid and substituting a part of the diol component with diethylene glycol.

In the loop type hook-and-loop fasteners with a heat-fusible resin layer of Example 5 and Example 6, the state of fusion between the weft yarn and warp yarn on the back surface and the heat-fusible resin layer was exactly the same as in Example 1. Further, the loop type hook-and-loop fasteners of Example 5 and Example 6 were similar to Example 1 in performance such as the bonding force to the adherend (cotton cloth and soft vinyl chloride sheet) and the engagement force of the hook-and-loop fastener, and were extremely excellent heat-fusible woven fabric loop type hook-and-loop fasteners.

On the other hand, in the loop type hook-and-loop fastener with the heat-fusible resin layer of Comparative Example 9, the sheath component of the weft yarn was partially melted when the heat-fusible resin layer was laminated, and the binder effect of the sheath component was reduced. As a result, the loop-shaped engagement element was pulled out from the woven fabric only by repeating the engagement and peeling 100 times, and the engagement force was decreased. Further, the non-uniformly extended loop-shaped engagement element has protruded from the surface of the woven fabric, and the hook-and-loop fastener had poor appearance.

In Comparative Example 10, when the polyester resin of the sheath component was melted to fix the yarn for engagement elements to the woven fabric, a part of the yarn for engagement elements was also melted and many engagement elements did not stand up from the surface of the woven fabric. Therefore, the obtained loop type hook-and-loop fastener with a heat-fusible resin layer had almost no engaging ability.

REFERENCE SIGNS LIST

1: Weft yarn
2: Warp yarn
3: Woven fabric (i)
4: Engagement element (ii)
5: Heat-fusible resin layer (iii)

The invention claimed is:

1. A heat-fusible woven fabric hook-and-loop fastener, comprising a woven fabric hook-and-loop fastener containing (i) a woven fabric composed of a warp yarn, a weft yarn, and a yarn for engagement elements and (ii) a hook-shaped or loop-shaped engagement element composed of the yarn for engagement elements, existing in large numbers on a surface of the woven fabric (i); and (iii) a heat-fusible resin layer formed of a polyester-based hot melt resin (A) laminated on a back surface of the woven fabric hook-and-loop fastener, wherein the following conditions (1) to (5) are satisfied:

(1) the weft yarn is a multifilament yarn composed of a core-sheath filament having a polyester-based hot melt resin (B) as a sheath component, and a root of the engagement element (ii) is fixed to the woven fabric (i) by being fused to the polyester-based hot melt resin (B);

(2) the heat-fusible resin layer (iii) has a basis weight in the range of 60 to 200 g/m$^2$;

(3) the polyester-based hot melt resin (B) has a melting point of 170 to 200° C., which is higher than a melting point of the polyester-based hot melt resin (A) by 50 to 110° C.;

(4) the heat-fusible resin layer (iii) is fused to the warp yarn forming the woven fabric (i) but is not fused to the weft yarn; and (5) the heat-fusible resin layer (iii) is directly laminated on a back surface of the woven fabric (i).

2. The heat-fusible woven fabric hook-and-loop fastener according to claim 1, wherein the melting point of the polyester-based hot melt resin (A) is 80 to 130° C.

3. The heat-fusible woven fabric hook-and-loop fastener according to claim 1, wherein each of the warp yarn, a core component of the weft yarn, and the yarn for engagement elements is a polyester-based yarn.

4. The heat-fusible woven fabric hook-and-loop fastener according to claim 3, wherein the polyester-based yarn comprises a polyester having a melting point higher than the melting point of the polyester-based hot melt resin (B) by 20 to 120° C.

5. A method for producing the heat-fusible woven fabric hook-and-loop fastener according to claim 1, the method comprising:

weaving the woven fabric hook-and-loop fastener formed by using the warp yarn, the weft yarn, and the yarn for engagement elements, wherein the warp yarn covers the weft yarn so as to wrap the weft yarn on the back surface of the woven fabric hook-and-loop fastener;

placing on the back surface of the woven fabric hook-and-loop fastener a molten sheet having a basis weight of 60 to 200 g/m$^2$ and formed of the polyester-based hot melt resin (A); and cooling and solidifying the molten sheet as it is, thereby forming the heat-fusible resin layer on the back surface of the woven fabric hook-and-loop fastener.

6. The method according to claim 5, wherein the molten sheet is heated to a temperature equal to or higher than the melting point of the polyester-based hot melt resin (A) and equal to or lower than a temperature 10° C. higher than the melting point of the polyester-based hot melt resin (B) and is placed on the back surface of the woven fabric hook-and-loop fastener.

* * * * *